United States Patent [19]

Daryoush et al.

[11] Patent Number: 4,751,513

[45] Date of Patent: Jun. 14, 1988

[54] LIGHT CONTROLLED ANTENNAS

[75] Inventors: Afshin S. Daryoush; Peter R. Herczfeld, both of Philadelphia, Pa.; Arye Rosen, Cherry Hill, N.J.

[73] Assignee: RCA Corporation, Princeton, N.J.

[21] Appl. No.: 858,771

[22] Filed: May 2, 1986

[51] Int. Cl.[4] ..... H01Q 00/00

[52] U.S. Cl. ..... 343/700 MS

[58] Field of Search ..... 343/700 MS

[56] References Cited

U.S. PATENT DOCUMENTS

| | | | |
|---|---|---|---|
| 3,680,136 | 7/1972 | Collings | 343/746 |
| 3,917,943 | 11/1975 | Auston | 250/211 J |
| 4,053,895 | 10/1977 | Malagisi | 343/700 MS |
| 4,231,049 | 10/1980 | Pearsall | 357/13 |
| 4,259,670 | 3/1981 | Schiavone | 343/700 MS |
| 4,281,253 | 7/1981 | Culver | 250/551 |
| 4,326,771 | 4/1982 | Henry et al. | 350/96.17 |
| 4,367,474 | 1/1983 | Schaubert et al. | 343/700 MS |
| 4,368,481 | 1/1983 | Ohashi et al. | 357/30 |
| 4,376,285 | 3/1983 | Leonberger et al. | 357/17 |
| 4,379,296 | 4/1983 | Farrar et al. | 343/700 MS |
| 4,382,261 | 5/1983 | Freibergs et al. | 343/854 |
| 4,386,357 | 5/1983 | Patton | 343/700 MS |
| 4,388,633 | 6/1983 | Vasudev | 357/17 |
| 4,396,833 | 8/1983 | Pan | 250/211 R |
| 4,399,453 | 8/1983 | Berg et al. | 357/81 |
| 4,475,108 | 10/1984 | Moser | 343/700 MS |
| 4,490,721 | 12/1984 | Stockton et al. | 343/368 |
| 4,529,987 | 7/1985 | Bhartia et al. | 343/700 MS |

OTHER PUBLICATIONS

Herczfeld et al.; "Optically Controlled Microwave Devices and Circuits"; *RCA Reviews* vol. 46; Dec. 1985, pp. 528–551.

An article entitled "Optoelectronically Pulsed Slot--Line Antennas" by Heidemann et al. published in Electronic Letters, Apr. 28, 1983, vol. 19, No. 9.

A paper entitled "Optical Control of Microwave PIN Diode and its Applications" by Sykes et al.; May 2, 1985.

An article entitled "Millimeter Wave Silicon Device and Integrated Circuit Technology" by Stabile et al., published in 1984 IEEE MTT-S International Microwave Symposium.

An article entitled "High Power Low-Loss PIN Diodes for Phased-Array Radar" by Rosen et al., published in RCA Review, Mar. 1979.

*Primary Examiner*—William L. Sikes

*Assistant Examiner*—Robert E. Wise

*Attorney, Agent, or Firm*—Henry I. Steckler; Allen L. Limberg

[57] ABSTRACT

The characteristics of antennas are modified by photosensitive electrical elements connected to the radiating elements. The photosensitive elements are biased by light, by direct electrical bias, or both. The photosensitive element may be a PIN diode. The bias may be applied by general illumination or conducted by a fiber optic cable.

24 Claims, 14 Drawing Sheets

LIGHT CONTROLLED ANTENNAS

This invention relates to antennas including photosensitive materials associated with the radiating for controlling electromagnetic radiation or other antenna characteristics in response to light.

BACKGROUND OF THE INVENTION

Modern electromagnetic communication and remote sensing systems are using increasingly higher frequencies. High frequencies more readily accommodate the large bandwidths required by modern high data rate communications and by such sensing arrangements as chirp radar. Also, at higher frequencies the physical size of an antenna required to produce a given amount of gain is smaller than at lower frequencies. Some high frequencies are particularly advantageous or disadvantageous because of the physical transmission properties of the atmosphere at the particular frequency. For example, communications are disadvantageous at 23 gigahertz (GHz) because of the high path attenuation attributable to atmospheric water vapor, and at 55 GHz because of oxygen molecule absorption. On the other hand, frequencies near 40 GHz are particularly advantageous for communication and radar purposes in regions subject to smoke and dust because of the relatively low attenuation at those frequencies. When a high gain antenna array is required, it is advantageous for each antenna element in the array to have physically small dimensions in the arraying direction. For example, if it is desired to have a rectangular planar array of radiating elements for radiating in a direction normal or orthogonal to the plane of the array, it is desirable that the physical dimensions of each antenna element in the plane of the array be small so that they may be closely stacked. For those situations in which an antenna array uses a large number of radiating elements, it is also desirable that the radiating elements be substantially identical to each other so that the radiation patterns attributable to each radiating element are identical.

It is difficult to generate large amounts of radio frequency (RF) energy at microwave frequencies (frequencies roughly in range of 3 to 30 GHz) and at millimeter wave frequencies (roughly 30 to 300 GHz), and the losses attributable to transmission lines and other elements tend to be quite high. These problems tend to reduce the power available for radiation by an antenna. Good engineering design, such as minimization of transmission path lengths, can maximize the power available for radiation from an antenna. It may be desirable, however, to tune the antenna to maximize radiated power, select polarization, or to allow the antenna to operate efficiently at various frequencies within an operating frequency range.

Antennas in the form of a rectangular conductive patch separated by a layer of dielectric material from a ground plane are known to provide certain advantages for millimeter wave operation, such as reasonable impedance match. Such antennas also have a relatively broad beamwidth which is suitable for use in antenna arrays in which the beam scans a large angle. Furthermore, such antennas may be readily fabricated by photographic techniques and arrayed together with strip transmission lines formed on the dielectric substrate.

It is known to adjust the frequency and performance of such patch antennas, as described in U.S. Pat. No. 4,367,474 issued Jan. 4, 1983, in the name of Schaubert et al. The Schaubert arrangement describes the placing of conductive shorting posts in prepositioned holes extending between points on the patch antenna and an underlying ground plane. Schaubert also describes the replacing of the conductive shorting posts by switching diodes which are coupled to the ground plane by bypass capacitors and which are also coupled to an external electrical bias circuit by radio frequency chokes. At millimeter wave frequencies, the placement of the holes and of the connections of the diodes, and the necessary bias arrangements in the vicinity of the radiating portion of the antenna are subject to manufacturing tolerances which make it difficult to obtain reliable performance and which therefore increase the cost of manufacture of arrays which include multiple radiating elements. These problems are exacerbated by the radiation and stray coupling between the antennas and the electrical control lines coupled to the switching diodes for electrical bias thereof. It is desirable to increase the reliability of performance of tuned antenna elements for reduction of cost of manufacture and for ease of arraying.

SUMMARY OF THE INVENTION

An antenna includes a dielectric plate having first and second broad sides. A first flat conductive region is attached to the first broad side and a second flat conductive region is also attached to the first broad side and separated from the first flat conductive region by a nonconductive gap. Another flat conductive surface attached to the second broad side of the dielectric plate defines a ground plane. The ground plane coacts with the first flat conductive region for, when energized, producing electromagnetic radiation with particular characteristics. A photosensitive semiconductor including first and second electrodes has a first electrode coupled to the first flat conductive region and a second electrode coupled to the second flat conductive region for, when conductive, coupling the first and second flat conductive regions together for producing electromagnetic radiation when the coupled first and second flat conductive regions are energized at a frequency. A light generator is coupled to the photosensitive semiconductor for biasing or controllably changing the electrical characteristics of the photosensitive semiconductor for controllably coupling the first and second flat conductive regions together for tuning the antenna for radiation at a frequency different then in the absence of light bias. In a particular embodiment of the invention, the photosensitive semiconductor is a PIN diode.

DETAILED DESCRIPTION OF THE INVENTION

Figure 1A:
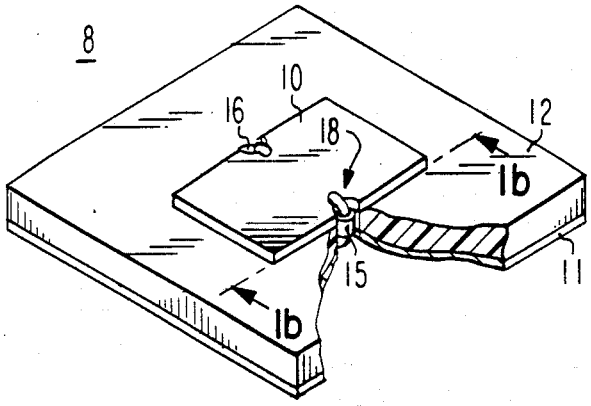
Fig. 1a PRIOR ART
FIG. 1*a* is a perspective view, partially cut away, of a patch antenna as in the prior art, together with its tuning diodes.
Figure 1B:
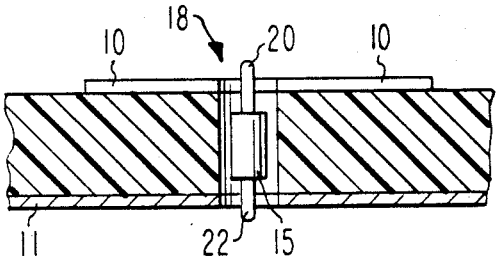
Fig. 1b PRIOR ART
FIG. 1*b* is a cross-sectional view of the prior art arrangement of FIG. 1*a;*

FIG. 1*a* illustrates a prior art patch antenna, generally as described in U.S. Pat. No. 4,529,987 issued July 16, 1985, to Bhartia et al., cut away to illustrate some of the connections which must be made in such an arrangement. In FIGS. 1*a* and 1*b*, an antenna designated generally as 8 in which the radiating element is a rectangular patch 10 of conductive material has path 10 separated froma conductive ground plane 11 by a thin dielectric layer 12. In accordance with the invention described by Bhartia et al, the bandwidth of the antenna is increased by the provision of a pair of varactor diodes, one of which is illustrated as 15, connected between the edges of patch 10 and ground plane 11. One way of implementing such an arrangement is to insert a discrete diode 15 having axial leads into a hole drilled or punched through dielectric plate 12 and ground plane 11 near the edge of patch 10. One such hole is illustrated as 16 in FIG. 1*a*, and the other hole through which diode 15 is inserted is partially cut away as viewed in FIG. 1*a* and is designated 18. FIG. 1*b* is a cross section of the arrangement of FIG. 1*a* looking in the direction of 1B—1B. As illustrated in FIG. 1*b*, the axial leads 20, 22 of diode 15 extend through hole 18 and are bent to make contact with conductive patch 10 and with conductive ground plane 11, respectively. The leads may be soldered or welded to patch 10 and to ground plane 11 as required to maintain good electrical contact.

An array of antennas similar to that of FIGS. 1*a* and 1*b* may be expensive to manufacture. When a plurality of conductive patches such as patch 10 are arrayed to form a multiple-antenna radiator, it is desirable that all the antennas have the same radiating characteristics and the same impedance characteristics. The radiating and impedance characteristics of the patch antenna, however, depend upon the net reactances of the tuning diodes, such as diode 15. The net reactance depends upon the location and orientation of the diode within the hole which it occupies, the diameters of the leads 20 and 22, and upon the exact location on patch 10 at which leads 20 and 22 are attached. Even when all of the these conditions are made uniform by great exactitude in manufacture, the net reactance of the tuning diodes of each antenna also depends upon the reactance of each diode of the array under a given bias condition. An equal electrical bias may be applied simultaneously to all diodes of the system by application of direct electrical bias over the common feed path (not illustrated in FIGS. 1*a* and 1*b*). At a given magnitude of electrical bias, the diodes may exhibit different values of capacitance and/or resistance. Even if the diodes are matched, their reactances under a particular bias condition may differ slightly from one unit to another.

Figure 2A:
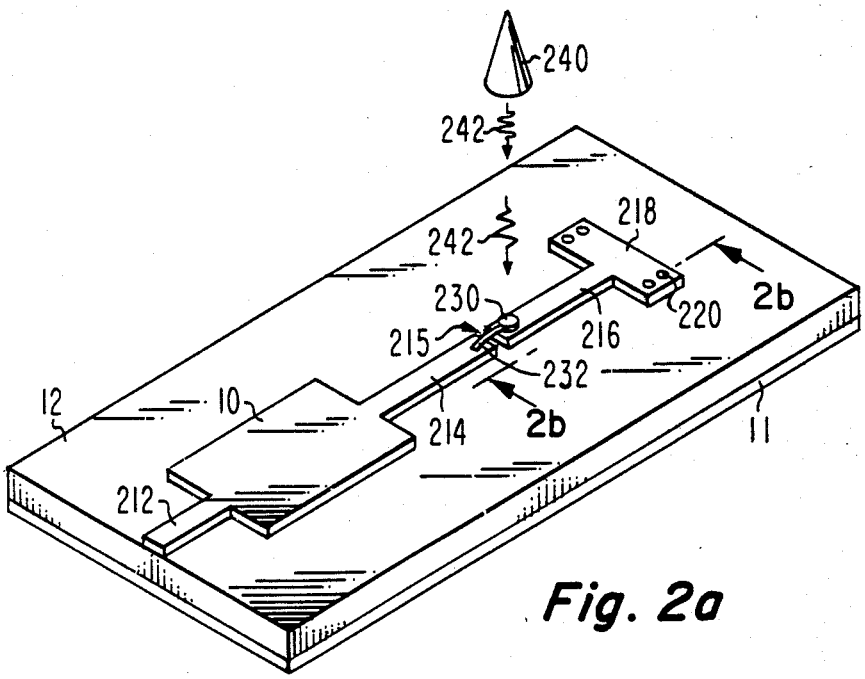
FIG. 2*a* is a perspective view of an antenna according to the invention.
Figure 2B:
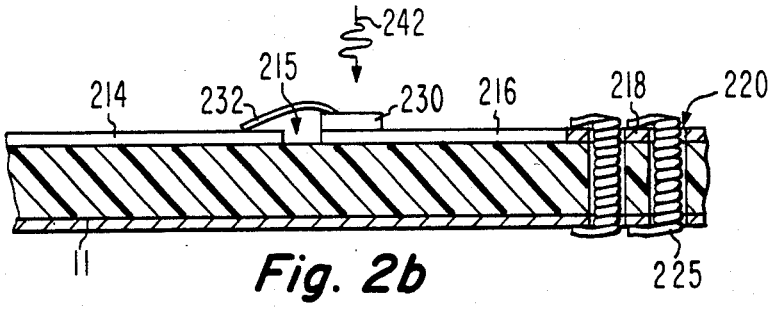
FIG. 2*b* is a cross section of the antenna of FIG. 2*a* in a direction 2B—2B.

FIG. 2*a* is a perspective view of an antenna 208 embodying the invention, and FIG. 2*b* is a cross section of a portion thereof taken along lines 2B—2B. Elements of FIGS. 2*a* and 2*b* corresponding to those of FIG. 1*a* are designated by the same reference numeral. In FIG. 2*a*, a dielectric plate 12 has affixed to its bottom a conductive ground plane 11. On the upper surface of plate 12 there are two separate structures and an interconnecting structure. The first structure includes a flat conductive portion 10 which is essentially a patch radiator similar to that illustrated in FIG. 1*a*, together with an elongated feed transmission line conductor 212 which coacts with ground plane 11 to form a feed transmission line (not separately designated) for feeding patch antenna 10 from a source of signals (not illustrated in FIG. 2*a*). The first structure also includes an elongated third conductor 214 which coacts with ground plane 11 to act as a transmission line (not separately designated). Conductor 214 extends from patch 10 along the upper surface of dielectric plate 12.

A second structure associated with the upper surface of plate 12 includes a further elongated conductor 216 which coacts with ground plane 11 to form a transmission line. Conductor 216 is aligned with conductor 214 and is separated from conductor 214 by a gap 215. The end of conductor 216 remote from gap 215 intersects the center of a further elongated conductor 218, the long dimension of which is oriented transverse to the long dimension of conductor 216. The ends of conductor 218 remote from the intersection with conductor 216 are short-circuited to ground plane 11 by solenoidal windings or chokes, one of which is illustrated as 225 in FIG. 2*b*, inserted into hole 220. In FIG. 2*a*, the locations of the holes into which DC short-circuiting solenoidal conductors such as 225 are inserted are illustrated by circles.

A discrete diode 230 is mounted on the end of conductor 216 adjacent gap 215. Diode 230 is in the general shape of a circular cylinder. Diode 230 has an electrode associated with its lower surface connected to conductor 216 and another electrode associated with its upper surface connected by way of a bond or jumper wire 232 to conductor 214. A controllable light source illustrated as 240 produces light symbolized by arrows 242 which illuminates diode 230 for altering its conduction characteristic (resistance and capacitance) for controlling the characteristics of antenna 208.

Figure 2C:
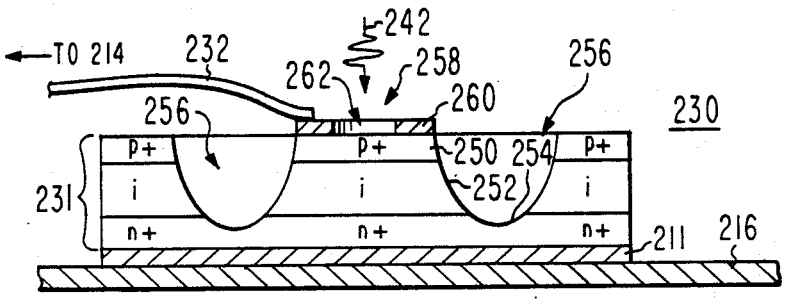
FIG. 2*c* is a cross-sectional view of discrete PIN diode 230 illustrated in FIGS. 2*a* and 2*b;*

FIG. 2*c* is a cross section of diode 230 of FIGS. 2*a* and 2*b*. Diode 230 as illustrated in FIG. 2*c* includes a semiconductor substrate 231, which may be silicon (Si) or gallium arsenide (GaAs) or any other photosensitive material. Vertically stacked layers 250, 252 and 254 of wafer or substrate 231 are heavily doped with acceptor impurities (p+), intrinsic (i), and heavily doped with electron donor impurities (n+), respectively. Layer 254 is bonded to a metallized electrode contact 211, which is in turn bonded to conductor 216. An annular moat 256 cuts through layers 250 and 252, and partially cuts through layer 254, to separate a central mesa 258 from the edges of the diode. The structure defines a PIN diode. The upper surface of p+layer 250 in the region of mesa 258 has bonded thereto an annular conductor 260 defining a central window or aperture 262 through which light 242 can enter the active or junction region of the diode structure. Important steps in the manufacture of a diode such as diode 230 are illustrated in FIGS. 15*a*–15*f*. Bonding conductor 232 is connected to conductor 260, thereby making contact between conductor 214 (FIG. 2*a*) and upper metallization 260 of PIN diode 230. Such PIN diodes are photosensitive, and change their electrical characteristics when illuminated, whether electrically biased or not.

In general, an antenna such as antenna 208 will radiate efficiently at a frequency established by the size of the aperture (the dimensions of patch 10 plus conductor 214) when the bias is such as to make diode 230 appear to be an open circuit or nonconductive. When diode 230 is biased so as to become partially or completely conductive, conductor 216 is excited by signal applied to patch 10 and conductor 214, and the size of the radiating aperture increases. Transmission-line like conductors 214 and 216 may actually radiate or merely change the characteristics of radiator 10. In any case, bias of diode 230 to render it conductive lowers the frequency of efficient antenna radiation.

Figure 3:
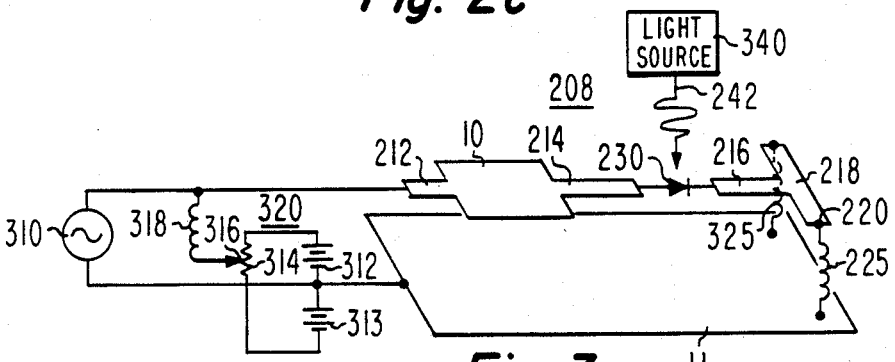
FIG. 3 is a diagram, partially in pictorial and partially in schematic form, illustrating the connections to the antenna illustrated in FIG. 2*a* for radiating energy therefrom.

FIG. 3 illustrates, partially in pictorial and partially in schematic form, the electrical connections required to radiate signal from a tuned antenna according to the invention and to apply electrical bias to the photosensitive portion of the antenna. Elements of FIG. 3 corresponding to elements of FIG. 2*a* and FIG. 2*b* are designated by the same reference number. In FIG. 3, a source 310 produces microwave or millimeter wave alternating (AC) signals which are applied by way of transmission line conductor 212 to radiating patch 210 for producing electromagnetic radiation. The reactances associated with diode 230 affect the radiation. Both the antenna radiation pattern and the radiating efficiency at a particular frequency may be controlled by control of the bias of diode 230. Light source 340 illuminates diode 230 with light illustrated by arrow symbol 242. The light changes the AC conduction characteristics of the diode. This in turn changes the impedance of antenna 208 as seen at feed conductor 212. Light bias may be used alone. It has been found that the effect of a given amount of illumination of diode 230 can be accentuated by application of an electrical bias.

As illustrated in FIG. 3, the bias includes a direct voltage having a polarity which may be selected to forward or reverse bias the junction of diode 230. The bias voltage is generated by a source of direct voltage designated generally as 320 which includes series connected batteries 312 and 313 oonnected across a potentiometer 314 having a movable tap 316. The center point between batteries 312 and 313 is connected to ground plane 11. Movement of tap 316 allows selection of any positive voltage up to the maximum voltage available from either battery 312 or any negative voltage up to the maximum voltage available from battery 313. Tap 316 is connected to transmission line conductor 212 by means of a low pass filter illustrated as an inductor 318 which, as known, allows the direct bias voltage (or current) to be applied to transmission line conductor 212 (and therefore by way of patch antenna 10 to the anode of diode 230), but prevents or reduces leakage of millimeter wave signals from transmission line conductor 212 into source 320 of bias voltage. Both direct voltage and direct current are often abbreviated DC. Various types of low pass filters are known in the art and further explanation is deemed unnecessary. The return path connection for bias voltage or current includes conductors 216, 218, choke solenoid 225 and a corresponding solenoid 325 on the other side of conductor 218, and ground plane 11.

Adjustment of the position of tab 316 varies the bias voltage across diode 230, and therefore the current therethrough, which affects its conduction characteristic and adjusts the impedance and therefore the radiating characteristics of antenna 208. At a forward bias voltage slightly less than the forward offset or junction voltage of the diode, little direct current flows. Slight increases in the bias voltages may cause disproportionate increases in conduction through diode 230, and at some point the current will be limited by the resistance of potentiometer 314. Reverse bias voltages can also be applied to the diode by appropriate selection of the position of tap 316. Reverse bias voltages tend to make the diode impedance high and reduce its effect on the antenna, which may be desirable for some operating situations.

Figure 5A:
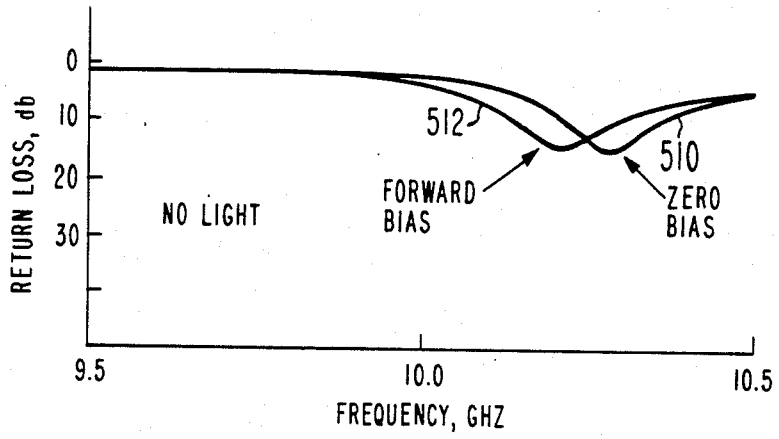
FIGS. 5*a* and 5*b* are plots of return loss versus frequency of an antenna similar to that illustrated in FIG. 2*a* without either electrical bias or incident light, with electrical forward bias and with both electrical and light bias of its diode.

FIG. 5*a* illustrates plots 510 and 512 of return loss of an antenna similar to antenna 208 as a function of the electrical bias condition of diode 230 in the absence of light. Diode 230 in this case is a silicon PIN diode. Return loss, as known, is a measure of the amount of electrical signal reflected by a load (in this case, the antenna) back to the source of electrical signal, compared with the amount of signal applied from the source to the antenna. Such reflected signal cannot be utilized by the load, and may adversely effect operation of the signal source. It is desirable to have as large a return loss (greatest attenuation) as possible at the operating frequency so as to maximize the amount of signal utilized. In the context of a transmitting antenna, utilization corresponds to signal radiation (except for $I^2R$ losses in the antenna). As illustrated by plot 510 in FIG. 5*a*, the return loss is a maximum of about 15 dB at about 10.28 GHz with zero electrical bias applied to diode 230, and with no illumination of the diode. Application of a forward bias current to diode 230 in the absence of light causes the diode to become significantly conductive, which in turn causes the frequency at which the return loss is maximized (maximum return loss, corresponding to maximum signal entering the antenna) to shift to about 10.20 GHz. This represents a downward shift in the tuning by about 80 megahertz (MHz)

Figure 5B:
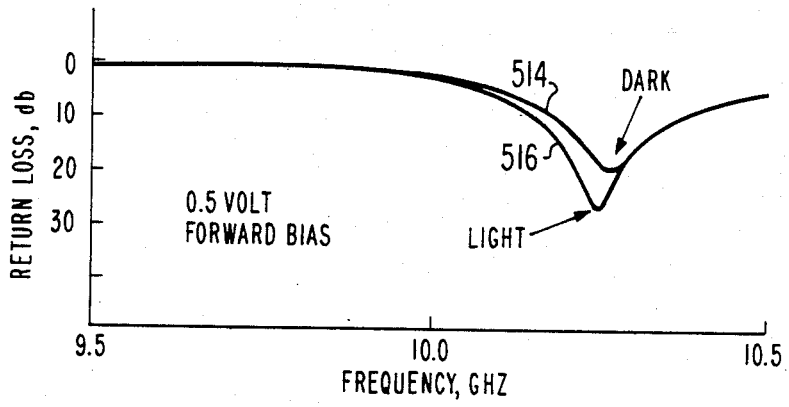

FIG. 5*b* illustrates by a plot 514 the return loss occasioned by 0.5 volts of forward bias in the absence of light. Since diode 230 is a silicon diode, the 0.5 volts is less than the threshold voltage or forward junction potential of the diode, which is about 0.65 volts. The forward bias voltage is insufficient to overcome the junction potential of diode 230, and therefore the forward bias current flow is small. As illustrated, the return loss has a maximum value of about 19 dB at a frequency of approximately 10.17 GHz. Plot 516 of FIG. 5*b* illustrates the result of illumination of diode 230 by white light having an intensity of one watt per square centimeter (W/centimeter$^2$). The application of light results in a downward shift of the radiating frequency of about 15 MHz, together with an improvement in the magnitude of the return loss by approximately 7 dB to about 26 dB.

It should be noted in conjunction with a discussion of antennas that transmission and reception of signals by an antenna are reciprocal, and that the antenna has the same gain, radiation pattern, and presents the same impedance to its terminals in both transmitting and receiving modes. In spite of this reciprocity, antenna descriptions are often couched in terms of "radiating" elements, "receiving" elements or the like, notwithstanding that the same elements having the same characteristics are involved, and the only difference is the direction of energy flow through what amounts to a transducer.

Figure 4:
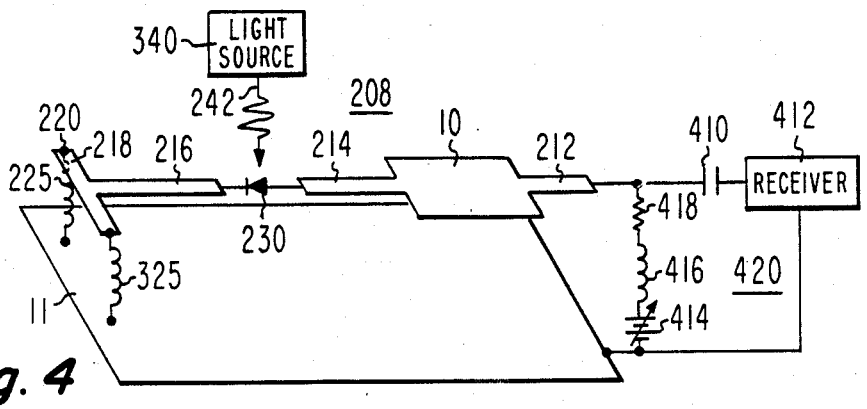
FIG. 4 is a diagram, partially in pictorial and partially in schematic form, illustrating the connections of the antenna of FIG. 2*a* for use in receiving signals.

FIG. 4 illustrates, partially in pictorial and partially in schematic form, the electrical connections required to apply electrical bias to, and to receive signals from, a tuned antenna according to the invention. Elements of FIG. 4 corresponding to elements of FIG. 2*a* are designated by the same reference numeral. In FIG. 4, antenna 208 receives millimeter wave signals which are coupled by way of transmission line conductor 212 and by a direct current blocking capacitor 410 to a receiver illustrated as a block 412 which may downconvert the received signal, demodulate and perform other known receiver functions. A source of direct voltage bias designated generally as 420 includes a source of direct voltage illustrated as a variable battery 414 having its negative terminal electrically connected to ground plane 11 and its positive terminal connected by a low pass filter (illustrated as the series combination of an inducto 416 and a resistor 418) to transmission line conductor 212. As the voltage produced by battery 414 is varied, the bias voltage applied by way of transmission line conductor 212, patch 10 and conductor 214 to bias the anode of diode 230 relative to its cathode also varies. The cathode of diode 230 is connected by way of conductors 216 and 218, by solenoidal conductors 225 and 325 and by ground plane 11 to the negative terminal of battery 414. The impedance presented by antenna 208 (patch antenna 10, diode 230 and its associated conductors) to the transmission line formed by conductor 212 in conjunction with ground plane 11, the gain and the receiving antenna pattern may be controlled by the bias applied to diode 230. As in the arrangement of FIG. 3, forward bias voltage generated by battery 414 having magnitudes less than the junction offset voltage of diode 230 results in relatively little current flow, and substantially the full bias voltage appears across diode 230. At bias voltages exceeding the forward junction potential, significant bias current flows, limited principally by resistor 418 and the forward resistance of diode 230.

Figure 7:
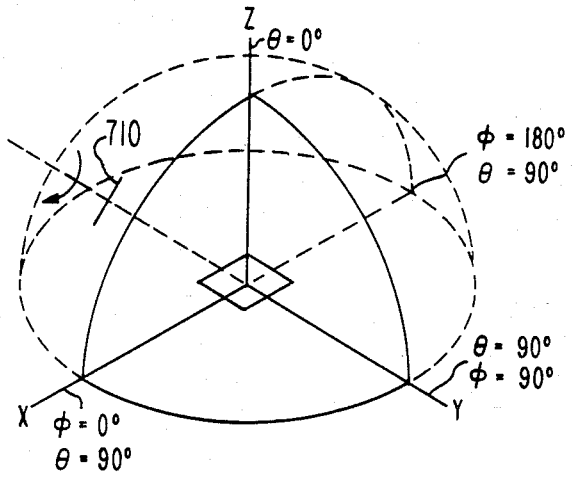
FIG. 7 is a diagram of the space around an antenna being tested as an aid in understanding the conditions under which the radiation patterns of FIGS. 6*a* and 6*b* were made.
Figure 6A:
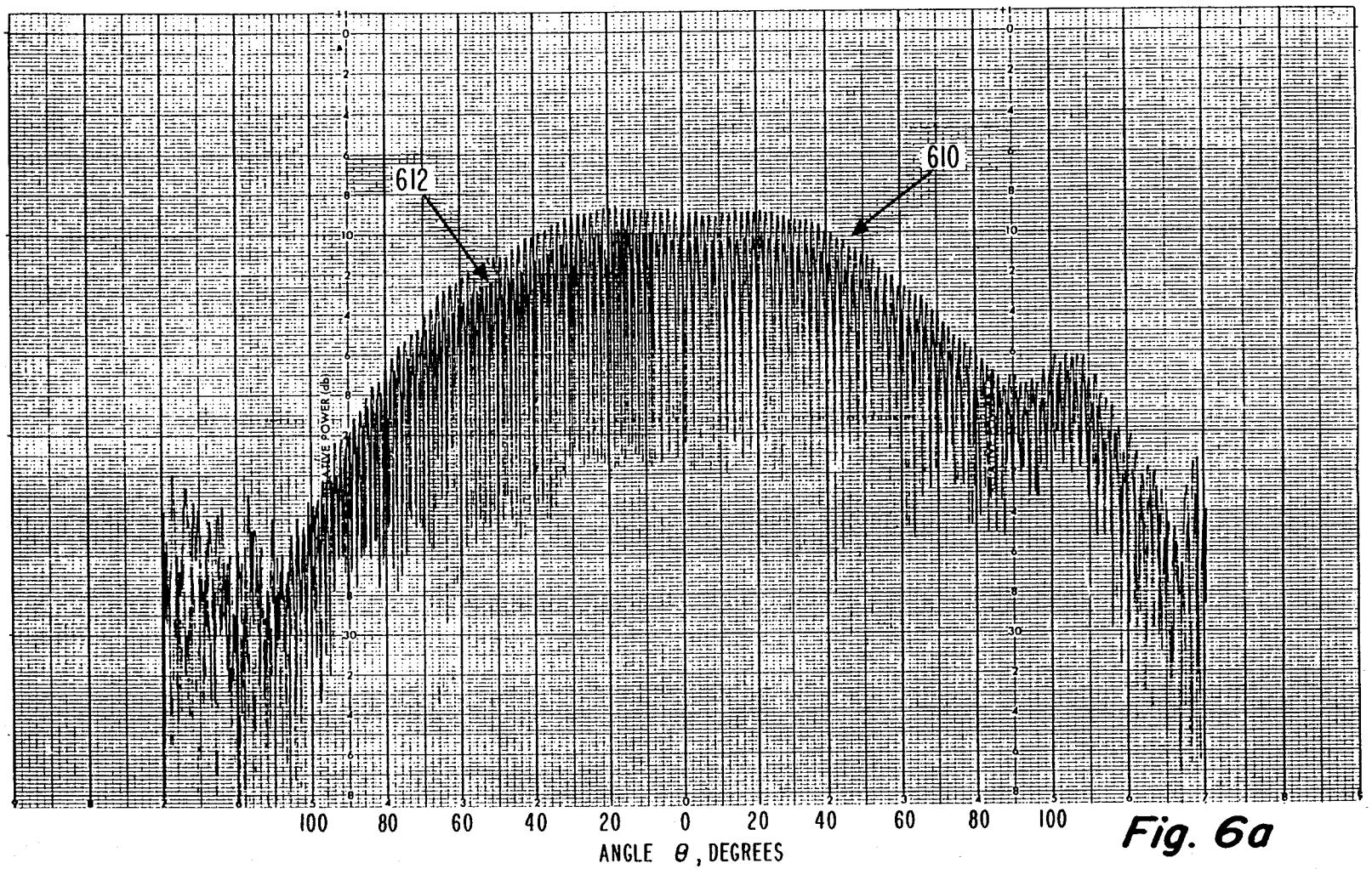
FIGS. 6*a* and 6*b* are radiation patterns of an antenna similar to that illustrated in FIG. 2*a* without bias, with electrical forward bias and with both electrical and light bias of the diode.
Figure 6B:
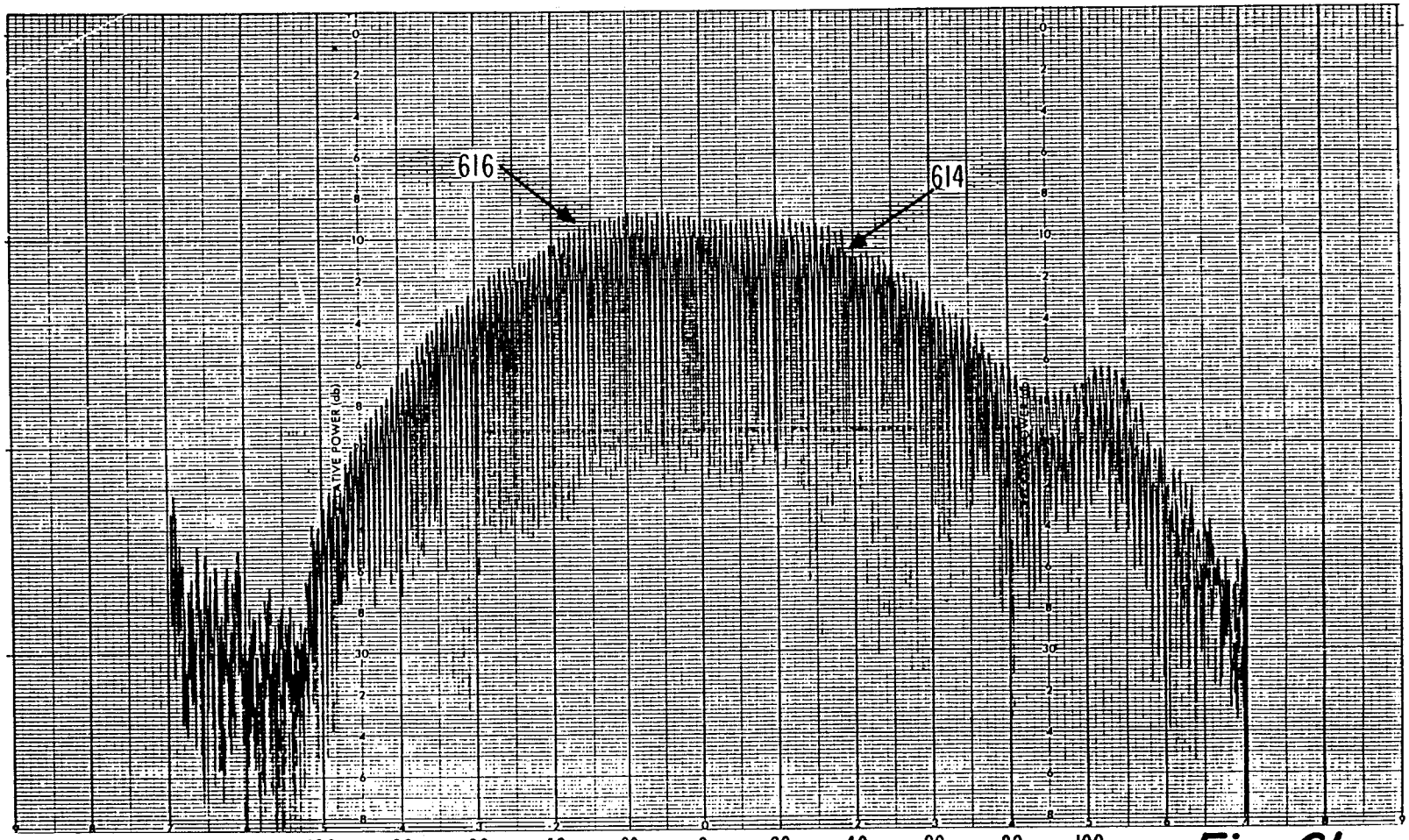

The radiation patterns of FIGS. 6*a* and 6*b* were made with the antenna of FIG. 2*a* operated in a receiving mode. However, due to the reciprocity of transmission and reception, the gain and radiation pattern of the antenna in the receiving mode are identical to those in the transmit mode. In order to make the radiation patterns of FIGS. 6*a* and 6*b*, the antenna is in effect mounted at the origin of a conventional coordinate system as illustrated in FIG. 7, with antenna ground plane 11 resting in the X-Y plane. With the antenna operated for reception, a linearly polarized transmitting antenna illustrated in FIG. 7 as 710 is rotated about its own axis so as to create a "spin-lin" condition in which the polarization of the transmitted signal is changed rapidly. While antenna 710 is spun about its own axis in order to rapidly vary the polarization of the transmitted signal, its angular position is changed ($\theta$ is varied) within the coordinate system at a constant separation or radius from the origin, from $\theta=90°$, $\phi=0°$ to $\theta=0°$ and then to $\theta=-90°$, $\phi=180°$. The amplitude response of the antenna under test (antenna 208) operated in the receiving mode is plotted as a function of angle $\theta$ to form plots such as those illustrated in FIGS. 6*a* and 6*b*.

FIG. 6*a* illustrates as a plot 610 the radiation pattern made under a condition in which transmitting antenna 710 radiates at 10.285 GHz and in which diode 230 is not electrically biased. As illustrated by plot 610, the change in amplitude attributable to the rapid change of polarization of the signal transmitted by antenna 710 exceeds 10 dB, and antenna 208 may therefore be considered to be linearly polarized. As also indicated by plot 610, the amplitude response is substantially equal (within $\pm 1$ dB) for angles of $\theta$ extending from $-60°$ to $+60°$. Plot 612 of FIG. 6*a* illustrates the corresponding amplitude response of antenna 208 when diode 230 is forward biased with a finite current. As illustrated, the gain is reduced by approximately 1 dB (from a relative response of 9 dB to a relative response of 10 dB) as a result of forward bias, by comparison with zero bias of diode. Plots 614 and 616 of FIG. 6*b* were made with antenna 710 (FIG. 7) transmitting at a frequency of 10.207 GHz. (a frequency 80 MHz below that at which the plots of FIG. 6*a* were made). Plot 614 represents a zero biased diode, and plot 616 represents a condition of forward current bias of diode 230. Consequently, while forward electrical bias of diode 230 caused a reduction in antenna gain compared with zero bias at 10.285 GHz, it caused an increase in gain of similar magnitude at 10.207 GHz. Thus, the bias of the diode affects the frequency of maximum return loss, without significant net effect on the radiation pattern or gain of the antenna.

Figure 8A:
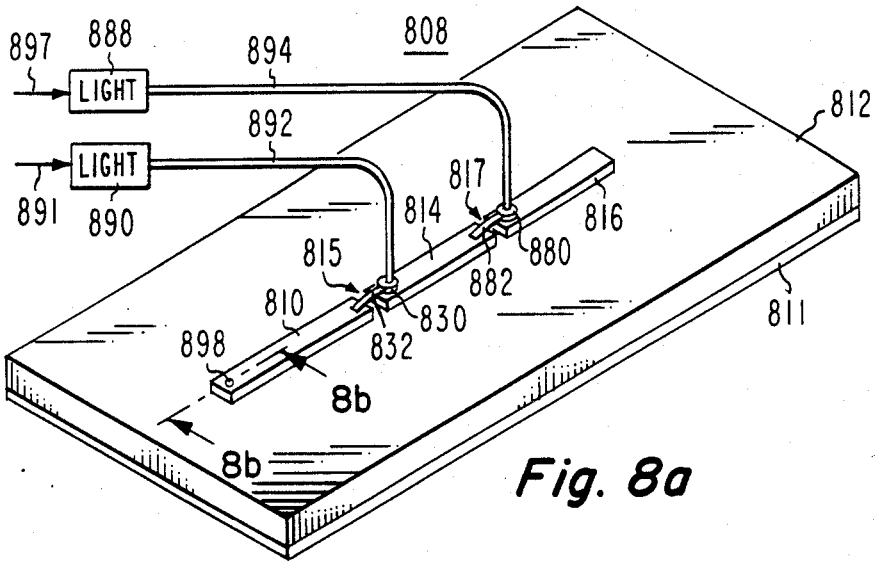
FIG. 8*a* is a perspective view of another antenna embodying the invention and using fiber optic cables.
Figure 8B:
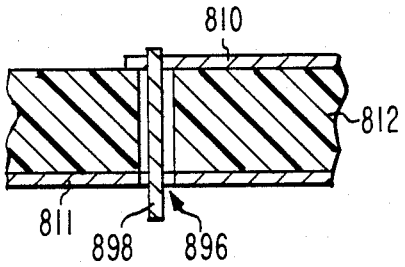
FIG. 8*b* is a cross-sectional view of a portion of the antenna of FIG. 8*a* taken in the direction 8B—8B illustrating the feed connection.

FIG. 8*a* is a perspective view, and FIG. 8*b* is a cross-sectional view of the feed portion of another antenna according to the invention. In FIG. 8*a*, antenna 808 includes a dielectric plate 812 having a conductive ground plane 811 attached to its bottom side. The broad top side of dielectric plate 812 includes three axially aligned conductors 810, 814 and 816 separated by non-conductive gaps 815 and 817. As illustrated in FIG. 8*b*, a conductor 898 extends from the bottom side of plate 812 through a hole illustrated in FIG. 8*b* as 896 to make contact with the end of conductor 810 which is remote from gap 815. Conductor 898 is a portion of a feed transmission line corresponding to transmission line conductor 212 of FIG. 2*a*. A diode 830 is mounted on the end of conductor 814 adjacent gap 815, and a further diode 880 is mounted on the end of conductor 816 adjacent gap 817. Each of diodes 830 and 880 has one electrode connected to the conductor on which it sits, and further includes second, upper electrode. A bond wire 832 connects the upper electrode of diode 830 to conductor 810 on the opposite side of adjacent gap 815. A similar bond wire 882 connects the upper electrode of diode 880 across gap 817 to conductor 814. A fiber optic cable 892 is connected to diode 830 and the other end is connected to a controllable light source illustrated as a block 890, and a fiber optic cable 894 has one end connected to diode 880 and the other connected to a further light source 888. As known, any waveguide medium for propagating light, such as glass fibers, have a dielectric constant different from that of the surrounding region, which keeps light constrained therein along their length. In the case of glass fibers, the dielectric constant is higher than that of the surrounding medium Light sources 888 and 891 are controlled by electrical conductors 897 and 891, respectively, from signal sources (not illustrated in FIGS. 8*a* or 8*b*).

When diodes 830 and 880 are nonconductive, antenna 808 includes as a radiating portion only conductor 810, which resonates at a frequency established by its dimension when energized from feed conductor 898. When diode 830 is rendered conductive and diode 880 is nonconductive, the radiating aperture of antenna 808 includes conductor 810 and conductor 814, and the frequency at which radiation is most efficient is lower than when radiation takes place by conductor 810 alone. When both diodes 830 and 880 are conductive, the radiating portion of antenna 808 includes conductors 810, 814 and 816, and the optimum frequency is still lower. Thus, by selectively rendering the diodes conductive, the radiating frequency of the antenna can be tuned. It should be noted that the diodes do not have to be operated in a switching mode in order to obtain the benefits of the invention. As known, the impedance of biased semiconductors such as PIN diodes can include at least resistances and capacitance which vary continuously over a range in response to the magnitude of the bias, both in the forward and reverse bias conditions. The continuous variation may be used to continuously vary the antenna characteristics.

In accordance with an aspect of the invention, light sources 852 and 856 are controlled to selectively apply light to diodes 830 and 880 in a manner selected to control the frequency of optimum radiation or the impedance at feed conductor 898.

Figure 8C:
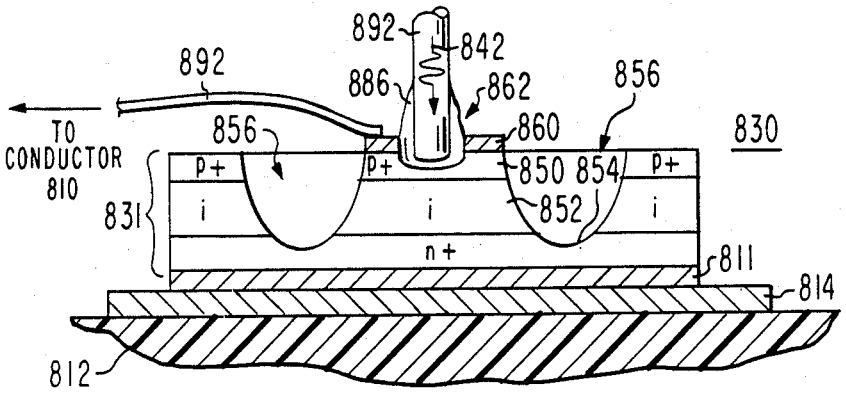
FIG. 8*c* is a cross-sectional view of a diode of the antenna of FIG. 8*a* illustrating the connection of a fiber optic cable to the diode.

FIG. 8*c* is a cross section of diode 830 of FIG. 8*a*. Elements of the diode of FIG. 8*c* corresponding to the diode of FIG. 2*c* are designated by the same reference numeral in the 800 series rather than in the 200 series. The only difference between diode 830 of FIG. 8*c* and diode 230 of FIG. 2*c* is the arrangement mounting fiber optic cable 892 to diode 830. As illustrated in FIG. 8*c*, the end of fiber optic cable 892 passes through window 862 and into a shallow well cut part-way into p+ layer 850. FIG. 16 illustrates the further processing step over those steps illustrated in FIGS. 15*a*–15*f* required to cut the shallow well. A bead of refraction index matched epoxy or other adhesive illustrated as 886 is used to retain the end of fiber optic cable 892 in position. With fiber optic cable 892 in the position illustrated, light illustrated by arrow 842 travelling through fiber optic cable 892 enters the photosensitive region of PIN diode 830 to alter its electrical characteristics. As described above, this in turn affects the radiating characteristic of the antenna. As described in conjunction with FIG. 2*a*, a radio frequency choke may be connected to conductor 816 and to ground, and electrical bias may be applied by way of feed conductor 898 to series connected diodes 830 and 880 to aid in the biasing if the sensitivity of the diodes at the available light intensity is insufficient to achieve the desired result.

Figure 8D:
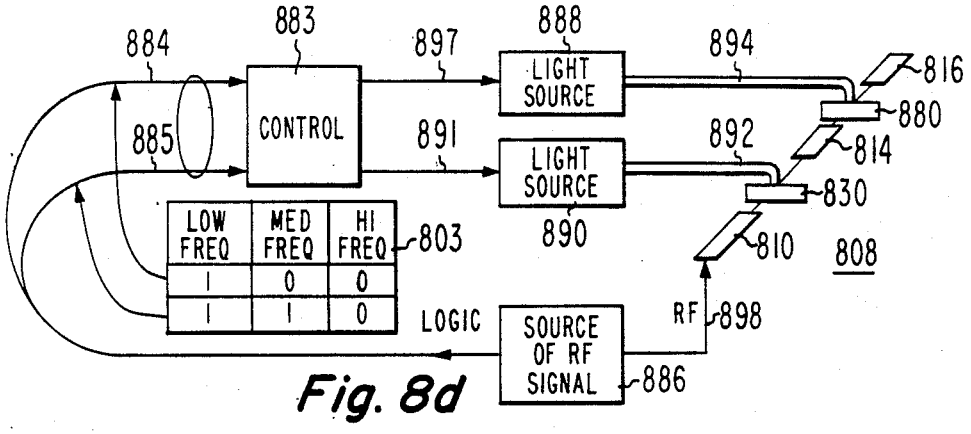
FIG. 8*d* illustrates in block diagram from a control arrangement including a control logic circuit for control of the antenna of FIG. 8*a;*

FIG. 8*d* illustrates a control circuit for antenna 808 of FIG. 8*a*. In FIG. 8*d*, elements corresponding to those of FIG. 8*a* are designated by the same reference numeral. In FIG. 8*b*, a source 886 of radio frequency signals applies RF signals by way of conductor 898 to the feed end of antenna 808. Source 886 produces signals at three frequencies: low, medium and high, corresponding to the three operating conditions of antenna 808. It simultaneously applies over conductors 884 and 885 digital signals representing the frequency then being generated. At the lowest frequency, a logic high level (logic 1) is applied to both conductors 884 and 885; at the high frequency, both conductors carry a logic low level (logic zero), and at an intermediate frequency conductor 884 carries a logic low level and conductor 885 carries a logic high level, all as indicated by a state chart designated 803 in FIG. 8*d*. These digital signals are applied to a control circuit illustrated as a block 883 which controls light sources 888 and 890 by way of electrical conductors 897 and 891, respectively.

Figure 8E:
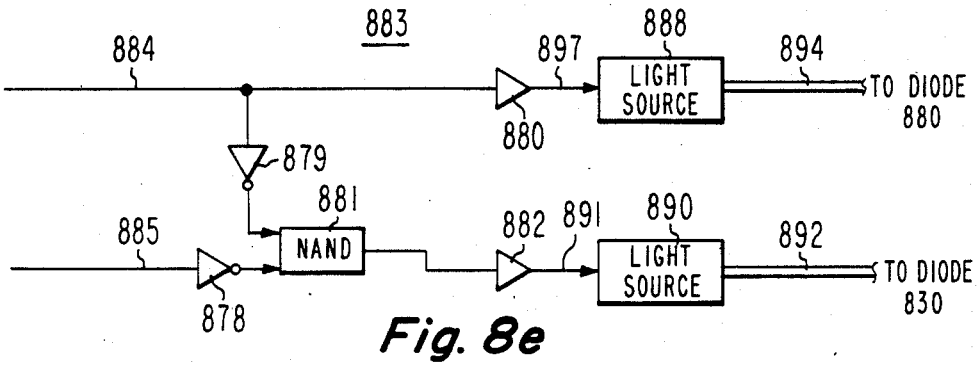
FIG. 8*e* is a simplified schematic diagram of the control logic circuit of FIG. 8*c;*

FIG. 8*e* illustrates a possible configuration of control circuit 883 for decoding the digital signals on conductors 884 and 885 for appropriate control of light sources 888 and 890. In FIG. 8*e*, elements corresponding to those of FIG. 8*d* are designated by the same reference numeral. In FIG. 8*e*, conductor 884 is connected by way of a noninverting amplifier 880 and a conductor 897 to light source 888. Conductor 884 is also connected by way of an inverting amplifier 879 to an input terminal of a NAND gate 881. Conductor 885 is connected by way of a further inverting amplifier 878 to another input terminal of NAND gate 881. NAND gate 881 is connected by way of a noninverting amplifier 882 and conductor 891 to light source 890 for control of diode 830.

In operation at the lowest frequency, it is desired that diodes 830 and 880 be conductive so as to make conductors 810, 814 and 816 radiating portions of antenna 808. At the lowest frequency, the digital signal on both conductors 884 and 885 is a logic high level. The logic high level on conductor 884 is amplified by amplifier 880 and energizes light source 888 to render diode 880 conductive. NAND gate 881 produces a logic low output signal only when both input signals are logic high. The logic high levels on conductors 884 and 885 are inverted by amplifiers 878 and 879 and applied to NAND gate 881, which responds with a logic high, which is amplified by amplifier 882 and applied by conductor 891 to light source 890 to render diode 830 conductive. Thus, at the lowest frequency, both diodes are rendered conductive to couple together conductive portions 810, 814 and 816 of antenna 808.

At high frequencies, it is desired that at least diode 830 be nonconductive, so that the radiating portion of antenna 808 is limited to conductor 810. At high frequencies, the logic low levels on conductors 884 and 885 are inverted by amplifiers 878 and 879 to produce logic high levels which are applied to NAND gate 881 to produce a logic low output, which deenergizes light source 890 and renders diode 830 nonconductive. With diode 830 nonconductive, RF signal applied to the feed end of conductor 810 cannot reach conductors 814 or 816. Consequently, the radiating portion of antenna 808 is only conductor 810, which is the minimum possible size.

Figure 8F:
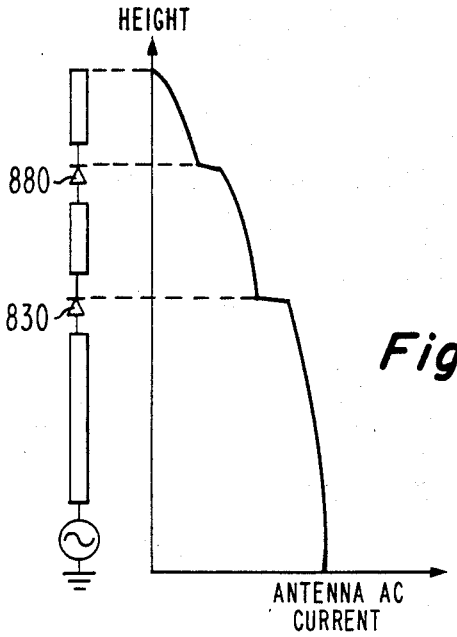
FIG. 8*f* is a plot illustrating the current distribution along the length of the antenna of FIG. 8*e* under a particular operating condition.

At frequencies intermediate the high and low frequencies, it is desired that diode 830 be conductive and diode 880 be nonconductive. At intermediate frequencies, conductor 884 has a logic low and 885 has a logic high level. These signals are inverted by amplifiers 878 and 879, to apply both logic high and low levels to inputs of NAND gate 881, which responds with a logic high output which energizes light source 890 to render diode 830 conductive. The logic low level on conductor 884 when applied by way of amplifier 880 to light source 888 produces no light output, and diode 880 remains nonconductive, as required FIG. 8*f* illustrates antenna signal current as a function of position along the antenna 808, illustrating the effect of biasing for finite reactances of diodes 830 and 880.

Figure 9B:
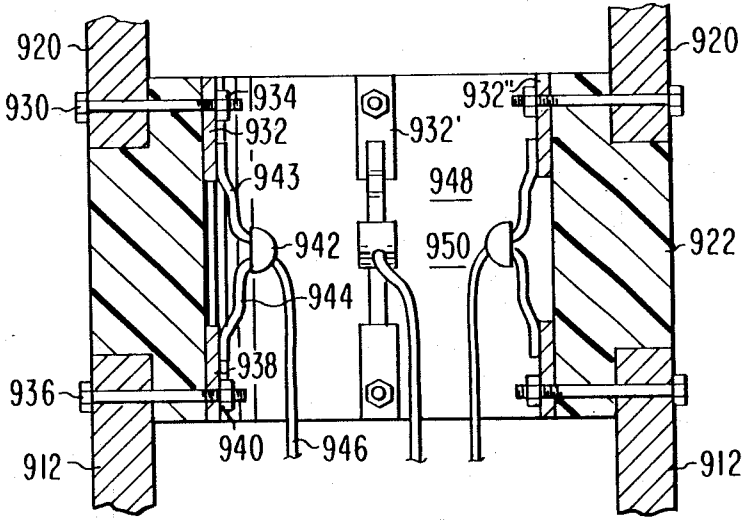
FIG. 9*b* is a cross section of portion of a structure of FIG. 9*a* illustrating internal details.
Figure 9A:
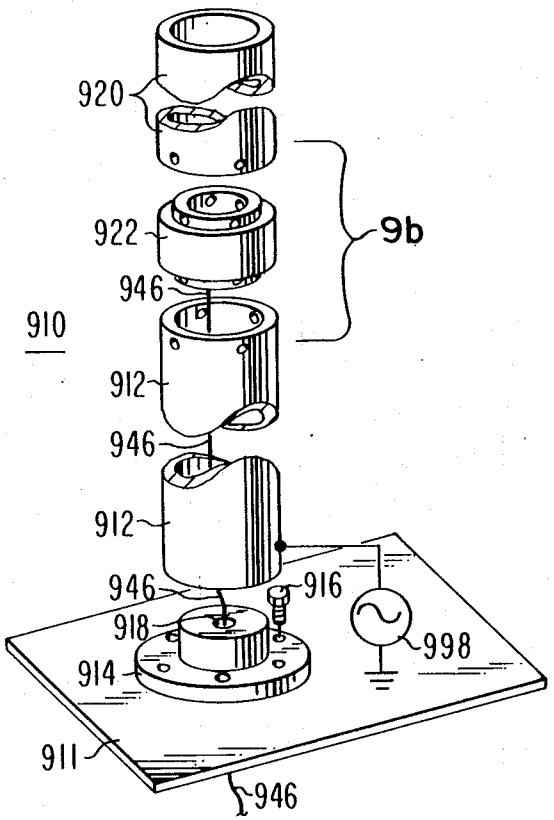
FIG. 9*a* is an exploded view of an antenna embodying the principles of the invention.

FIG. 9*a* illustrates in exploded view a monopole antenna according to an embodiment of the invention. In FIG. 9*a*, a first vertically oriented conductive tube 912 has an internal bore dimensioned to fit over a portion of a nonconductive mounting flange 914 arranged for insulated mounting of tube 912 spaced from a ground plane 911. Flange 914 is bolted to ground plane 911 by bolts, one of which is illustrated as 916. Mounting flange 914 has a central aperture 918 bored therethrough, through which fiber optic cables, discussed below, can pass to a control source located below ground plane 911. A signal source energizes the lower end of tube 912 relative to ground plane 911. A further conductive tube 920 is mechanically fastened to, but insulated from tube 912 by a nonconductive mounting member 922. Nonconductive member 922 is illustrated in cross section in FIG. 9*b*. As illustrated, a rigid mechanical mounting is provided by conductive bolts, one of which is illustrated as 930, passing through the walls of the tubes and of dielectric element 922, together with associated nuts (not separately designated). In accordance with the invention, electrical connection is made between lower tube 912 and upper tube 920 by way of a photosensitive conductor arrangement. The photosensitive conductor arrangement is illustrated in FIG. 9*b*. As illustrated, each bolt such as bolt 930, makes contact with the associated tube such as tube 920 and is therefore electrically connected thereto. An elongated vertically oriented conductive bar 932 is in conductive contact with bolt 930 and is retained in place by a nut 934. Bar 932 extends downward towards tube 912. Other conductive bars 932', 932'' are similarly in conductive contact with upper tube 920. Another bolt 936 is in contact with lower tube 912 and is connected to a bar 938 by a nut 940, establishing conductive contact between bar 938 and lower tube 912. Other bars 938', 938'' are similarly in contact with lower tube 912. Consequently, representative conductive bars 932 and 938 are available for electrical connection to upper tube 920 and lower tube 912 within annular support 922. As illustrated, a packaged semiconductor 942 is located within annular support 922 and has leads 943 and 944 connected to bars 932 and 938, respectively. A fiber optic cable 946 is connected to the photosensitive semiconductor. Other packaged semiconductors 948 and 950 are connected in parallel with semiconductor 942 and are controlled by other fiber optic cables.

Figure 9C:
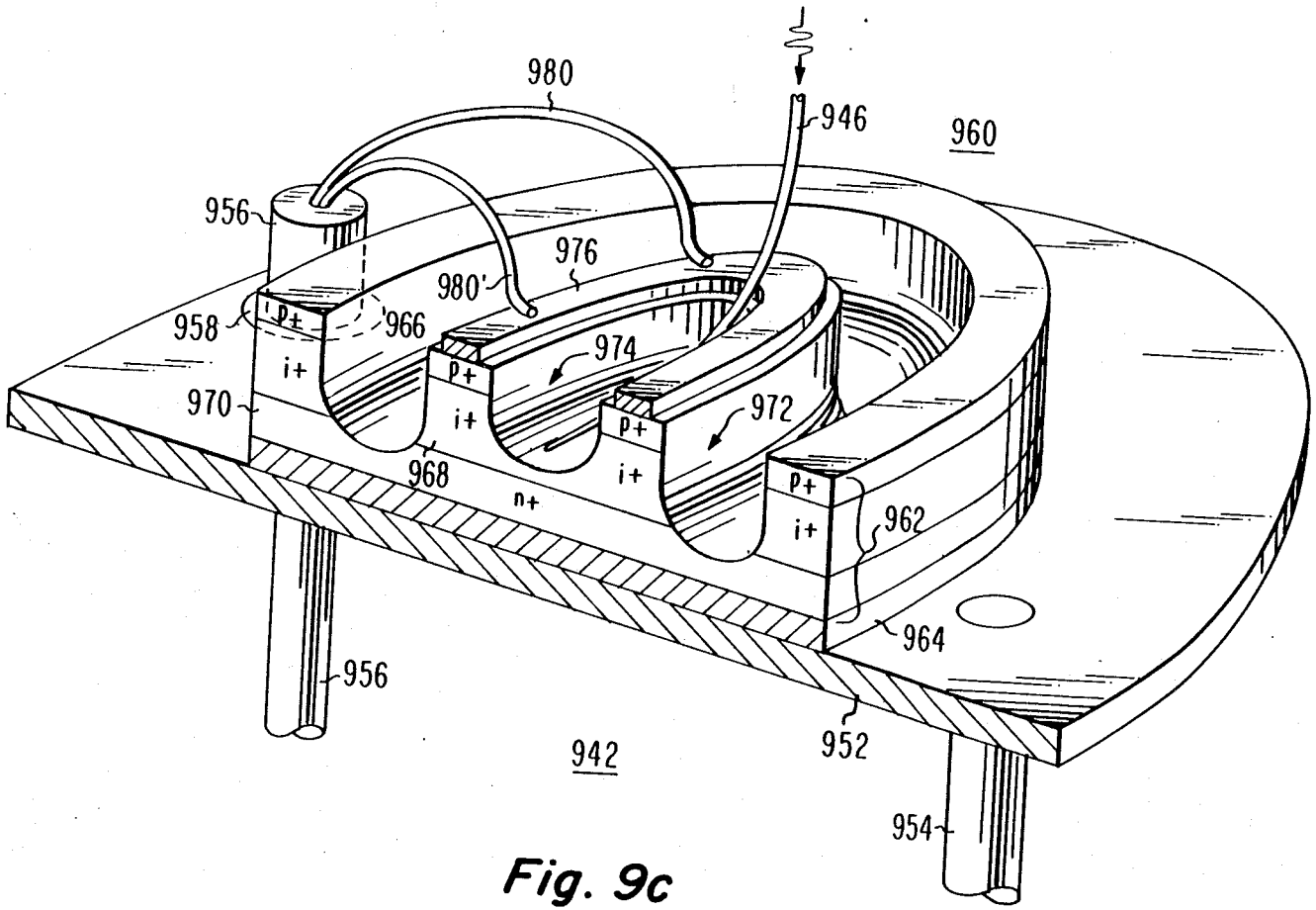
FIG. 9*c* is a cutaway perspective view of a portion of a packaged PIN diode which may be used in the arrangement of FIG. 9*b;*

FIG. 9*c* is a perspective view illustrating packaged semiconductor 942 in detail. As illustrated, a protective cover has been removed to expose interior details. In FIG. 9*c*, packaged semiconductor 942 includes a flat conductive base 952 to which a lead 954 is conductively bonded. A further lead 956 passes through a supporting insulator 958. PIN diode 960 is mounted on base plate 952. Diode 960 includes a semiconductor substrate 962 having a conductive layer 964 bonded thereto and to base plate 952. As described in conjunction with diode 230 of FIG. 2*c*, diode 960 includes a vertically arrayed doping arrangement of a p+ region 966, an i region 968 and an n+region 970. As illustrated in FIG. 9*c*, substrate 962 of diode 960 is elongated rather than circular in shape, and an elongated moat 972 extends about the diode, separating a central mesa region from an outer periphery of substrate 962. The central region of substrate 962 includes a trench 974 which passes through p+ region 966 and part-way through i region 968 Contact is made between lead 956 and electrode metallization 976 overlying p+ region 966 in the central mesa region by way of one or more conductors 980, 980'. The end of fiber optic cable 946 is tapered to a point, and lies in trench 974. Fiber-optic cable 946 is retained in position in trench 974 by adhesive (not illustrated). As known, a gradual taper of a fiber optic cable results in radiation of light along the length of the taper. The light leaving fiber optic cable 946 is directed towards the active region of diode 960. Consequently, the arrangement of packaged diode 942 is an elongated PIN diode in which the light output is distributed along the length of the structure. The elongated structure tends to keep the current density at any point within the diode relatively low, and provides low reactance and good heat dissipation capability.

Figure 10A:
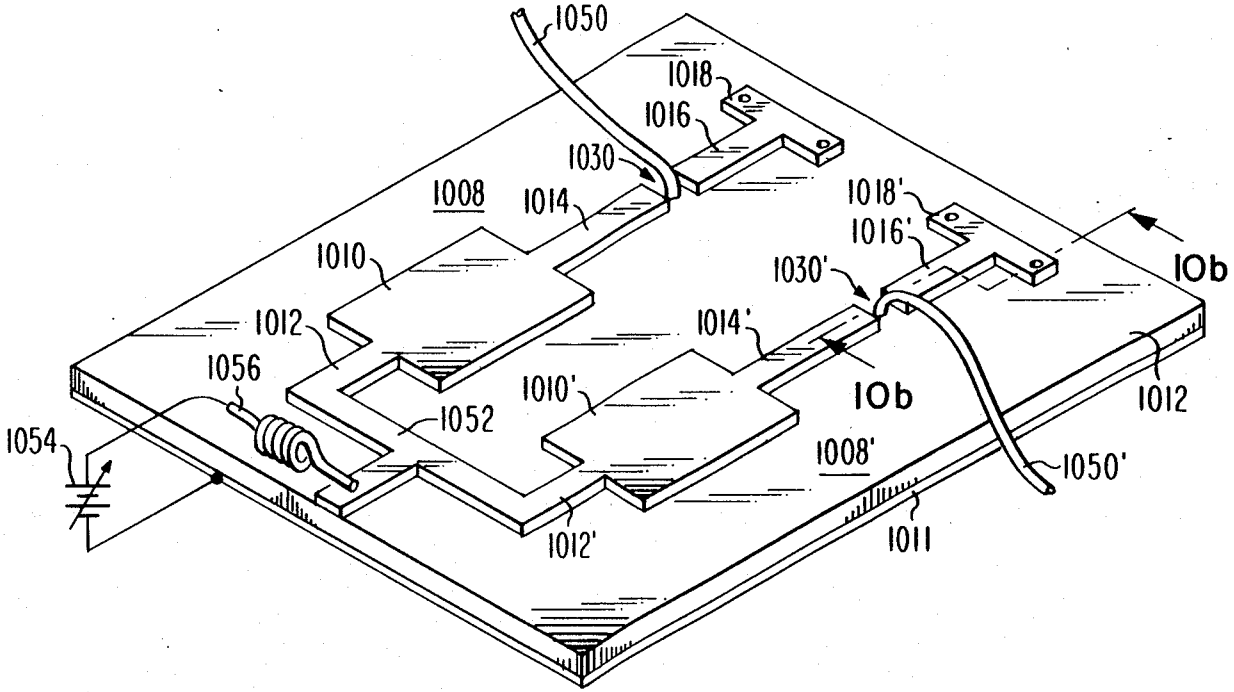
FIG. 10*a* is a perspective view of an array of antennas embodying the invention.

FIG. 10*a* illustrates an antenna array according to another embodiment of the invention. In FIG. 10*a*, a semiconductor substrate 1012 overlies a ground metallization 1011. An array of two antennas 1008 and 1008' is defined by patterns of metallization on, and doping within, semiconductor substrate 1012. In antenna 1008, elements corresponding to elements of antenna 208 of FIG. 2*a* are designated by the same reference numeral in the 1000 series rather than the 200 series. Antenna 1008 includes a radiating patch 1010, a further radiation affecting conductor 1014, and a photosensitive element 1030 formed within substrate 1012, coupling together conductor 1014 and a further conductor 1016. Conductor 1016 is connected by way of a choke 1018 and through conductors (not illustrated) to ground metallization 1011. A fiber optic cable 1050 has one end adjacent photosensitive element 1030. Antenna 1008' is identical to antenna 1008. Conductor 1010 is connected to a feed conductor 1012, and conductor 1010' is connected to a corresponding feed conductor 1012'. Feed conductors 1012 and 1012' are connected together in a common or corporate feed arrangement by a further conductor 1052. Electrical bias may be applied from a bias source illustrated as 1054 by way of a choke illustrated as 1056. It will be noted that the electrical bias applied to conductor 1052 is applied equally to photosensitive elements 1030 and 1030'.

Figure 10B:
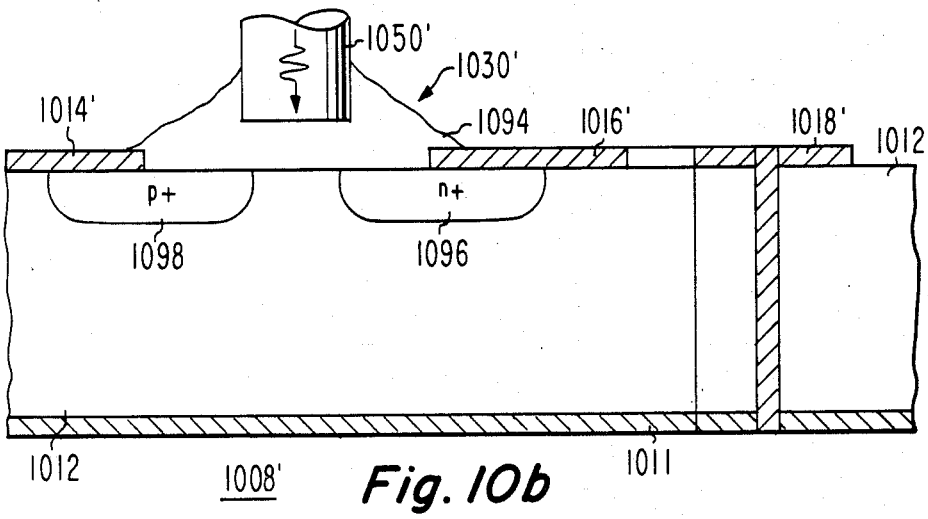
FIG. 10*b* is a cross section of the structure of FIG. 10*a* taken along the lines 10B—10B.

FIG. 10*b* is a cross-sectional view of a portion of antenna 1008' looking in the direction 10B—10B. In FIG. 10*b*, it can be seen that the principal portion of substrate 1012 is intrinsic (i) semiconductor (semiconductor without significant impurities which affect its conductivity). A region 1098 extending under conductor 1014' and into gap 1030' is heavily doped with acceptor impurities to form a p+ region 1098. Another region lying under conductor 1016' and extending into gap 1030' is heavily doped with electron donor impurities to form n+ region 1096. Regions 1096 and 1098 are everywhere separated by i material, thereby defining a lateral PIN diode extending between conductors 1014' and 1016'. Fiber optic cable 1050' ends near gap 1030' and is oriented to direct light towards to the junction region between the i region and the adjacent p+ and n+ regions. A clear adhesive material or epoxy illustrated as 1094 keeps the end of fiber optic cable 1050' in the proper location for illuminating the junction.

The junctions of the diodes 1030, 1030' of antennas 1008 and 1008', respectively, of FIG. 10*a* may be illuminated with the same amount of light, or the amount of light may be adjusted to compensate for differences in the impedance of the diodes. The magnitude of the light applied to diodes 1030, 1030' may be increased or decreased simultaneously so as effect simultaneous tuning of antennas 1008 and 1008' of the array illustrated in FIG. 10*a*, or they may be selectively illuminated with different amounts of light to change the impedance presented by each antenna at the corporate feed point so as to adjust the reactance and conductance (phase and magnitude) of the feed current entering each antenna to perform beam direction scanning.

Figure 11A:
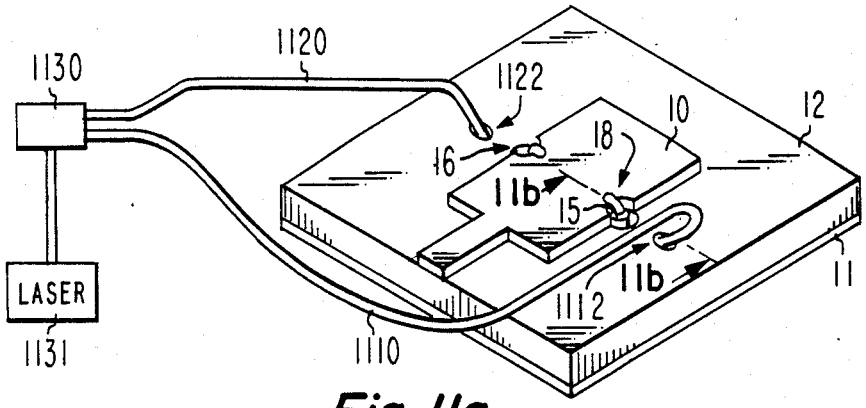
FIGS. 11*a* and 11*b* are perspective and cross-sectional views, respectively, of another antenna embodying the invention.
Figure 11B:
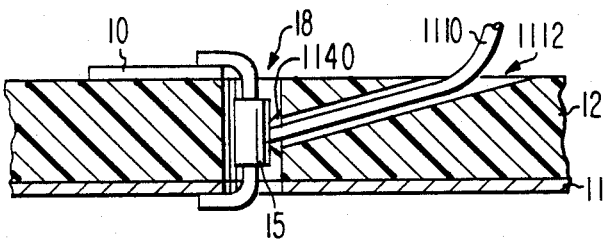

FIGS. 11*a* and 11*b* illustrate a patch antenna similar to that illustrated in the aforementioned Bhartia et al. patent, modified by the use of glass-encapsulated photosensitive semiconductors. Elements of FIG. 11*a* and 11*b* corresponding to FIGS. 1*a* and 1*b* are designated by the same reference numeral. As illustrated in FIGS. 11*a* and 11*b*, patch antenna 10 has discrete diodes, one of which is designated 15, inserted into holes such as 18 drilled or punched through the structure. In the embodiment of FIGS. 11*a* and 11*b*, diode 15 is glass-encapsulated, and the diode structure therein is photosensitive. Fiber optic cables 1110 and 1120 are connected to a fiber optic star coupler illustrated as 1130 which receives light from a laser light source 1131 and which divides the received light and applies substantially equal amounts of light to cables 1110 and 1120. The ends of fiber optic cables 1110 and 1120 remote from star coupler 1130 are inserted through skewed holes 1112 and 1122, respectively, to bear against the side of the associated glass-encapsulated diode. As illustrated in FIG 11*b* fiber optic cable 1110 passes through skewed hole 1112 and bears against the side of diode 15. As in the case of the array of FIG. 10*a*, the fiber optic cables do not substantially interfere with the radiation of electromagnetic signals. A bead of adhesive illustrated as 1140 holds the end of fiber optic cable 1120 in contact with the side of diode 15. Such a structure is readily usable with conventional components for achieving frequency, polarization, and other types of diversity as known in the prior art, under the control of light.

Figure 12A:
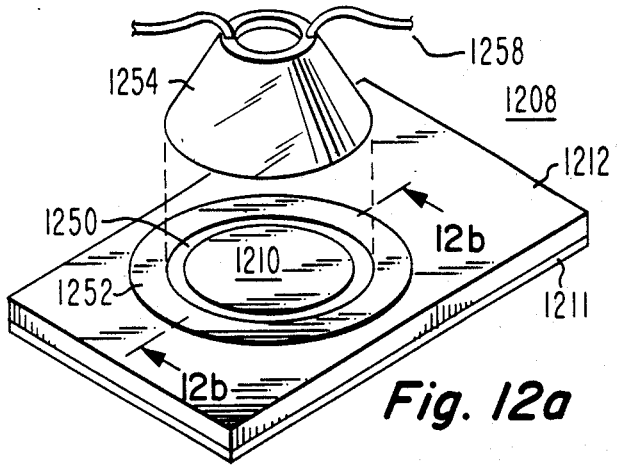
FIG. 12*a* is an exploded perspective view of another antenna embodying the invention.
Figure 12B:
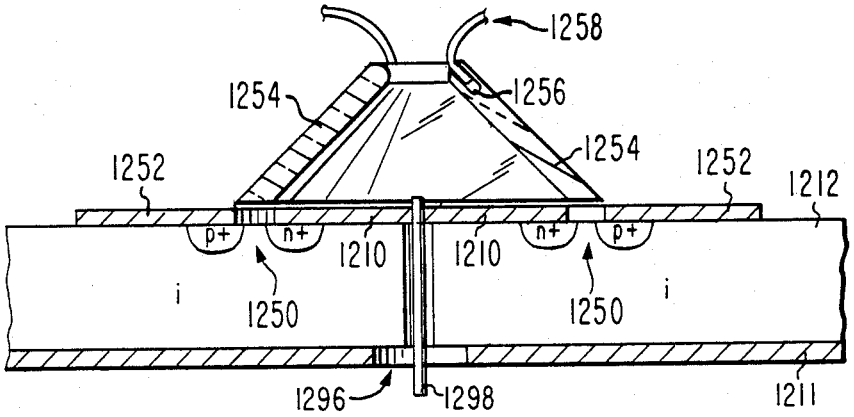
FIG. 12*b* is a cross section of the structure of FIG. 12*a* in its assembled form, taken along the lines 12B—12B.

FIG. 12*a* illustrates in exploded view another embodiment of the invention in which a patch antenna 1208 includes a circular conductive patch 1210 formed on a semiconductor substrate 1212 is coupled by an annular monolithic lateral PIN diode 1250 to a further conductive annulus 1252. A truncated conical member 1254 is formed from a clear thermoplastic material having a relatively high dielectric constant. Lamps, one of which is illustrated as 1256 in the cross section of FIG. 12*b*, are embedded in the upper edge of member 1254. The lamps are powered by conductor pairs such as 1258 and together with member 1254 produce an annular ring of light for controlling diode 1250. A feed conductor 1298 extends through a hole 1296 drilled or punched through conductor 1210 and substrate 1212. Ground plane 1211 defines a clear region around conductor 1298 to prevent short-circuiting thereto. Conductor 1298 is soldered to conductor 1210.

When lamps such as 1256 are illuminated, the light is guided through the lower edge of member 1254 and illuminates the active portion of annular diode 1250, thereby selectively affecting the conduction characteristics of the diode. This in turn controls the coupling of circular patch conductor 1210 to annular conductive patch 1252, thereby in turn affecting the aperture dimensions of patch antenna 1208 and affecting its characteristics.

Figure 13:
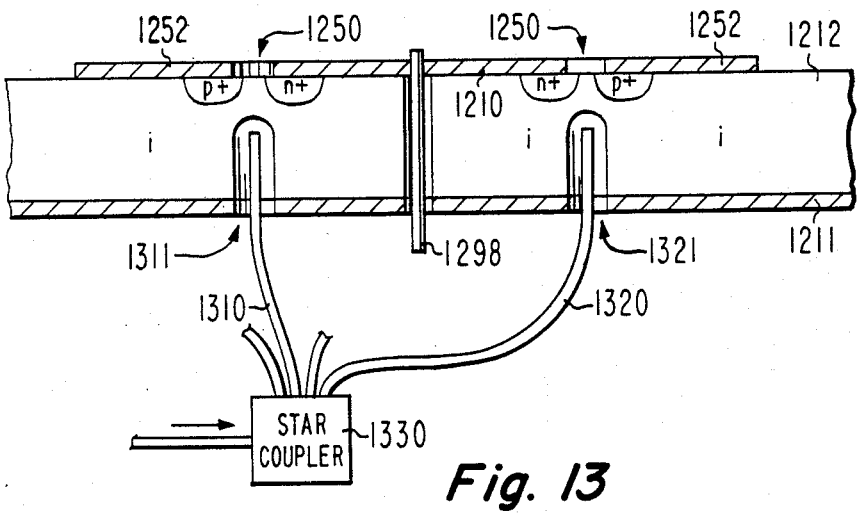
FIG. 13 is a cross section of an antenna similar to that of FIG. 12*a* illustrating an alternative method for illuminating the diodes by means of fiber optic cables.

FIG. 13 is cross-section of an annular patch antenna similar to that illustrated in FIG. 12*a*, but which provides light to annular diode 1250 by means of a number of fiber optic cables such as 1310, 1320 originating from a star coupler 1330. The ends of fiber optic cables 1310 and 1320 are fitted into a corresponding set of holes 1311 and 1321 drilled part-way through substrate 1212 from the ground side. The ends of fiber optic cables 1310 and 1320 direct the light towards annular diode 1250 at sufficient points around the periphery to create a sufficient number of conducting points to simulate a continuous annular connection. An advantage of the arrangement of FIG. 13 by comparison with that of FIGS. 12*a* and 12*b* lies in that radiation of signal from the antenna is not impeded by light distributing structure 1254.

Figure 14:
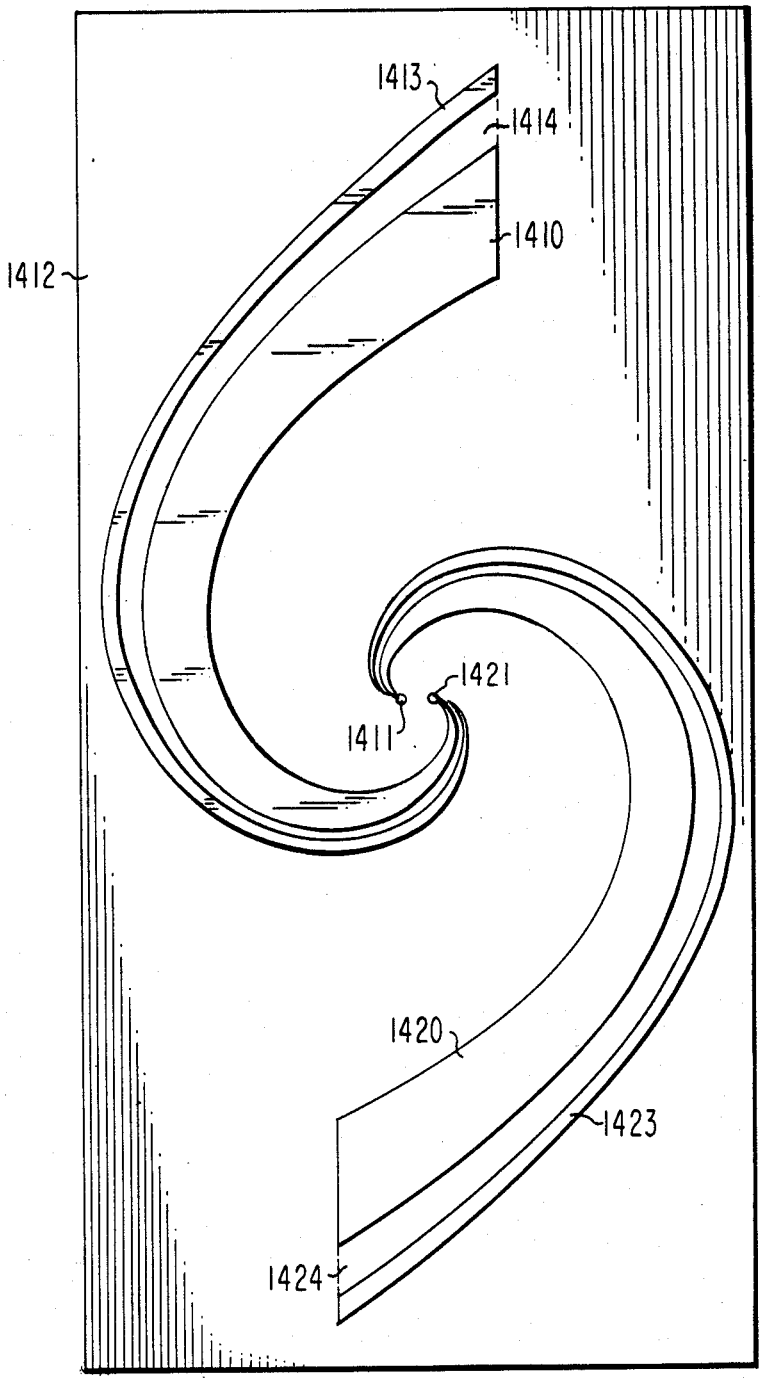
FIG. 14 is a plan view of a semiconductor substrate illustrating a portion of an equiangular spiral antenna embodying the invention.

FIG. 14 illustrates in plan view an arrangement of conductive arms 1410, 1420 arranged in the form of an equiangular spiral on the surface of a semiconductor substrate 1412. Equiangular spirals are well known in the art, and are described at Chapter 18.2 of "Antenna Engineering Handbook", first edition, edited by Jasik. As known, such spirals, as with many balanced antenna structures, do not require a ground plane in order to effect radiation. Conductive arms 1410 and 1420 are fed in balanced form in conventional manner from points 1411, 1421. In accordance with the invention, the impedance presented by arms 1410 and 1420 at feed point 1411, 1421 may be changed by changing the effective width of the arms. In effect, this controls the width of the conduction of a transmission line extending from the feed point to the radiating region. A further set of conductive spirals 1413 and 1423 also have equiangular form, but do not connect directly to feed points 1411, 1421 or to spirals 1410, 1420. A distributed lateral PIN diode 1414 is formed within the surface of substrate 1412 in the region between spiral arms 1410 and 1413, and a similar distributed lateral PIN diode illustrated as 1424 is formed within the surface of substrate 1412 in the region between conductive spiral arms 1420 and 1423. A source of illumination (not illustrated in FIG. 14) controllably illuminates diodes 1414 and 1424 to thereby control the conductive characteristics thereof to control the effective width of the spiral arms and thereby change the impedance of the antenna without changing the radiation characteristic.

Figure 15A:
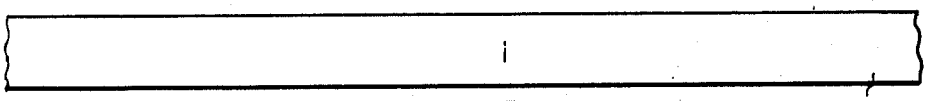
FIGS. 15*a*–15*f* illustrate steps in the fabrication of a vertical PIN diode similar to that of FIG. 2*c.
Figure 15B:
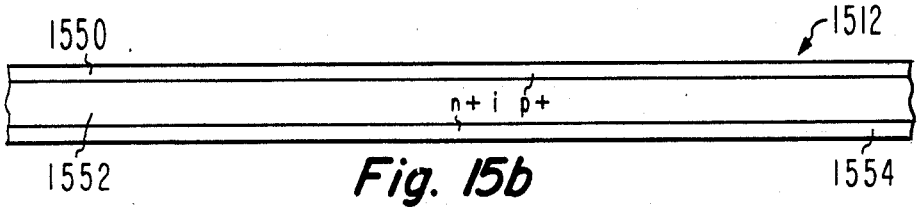
Figure 15C:
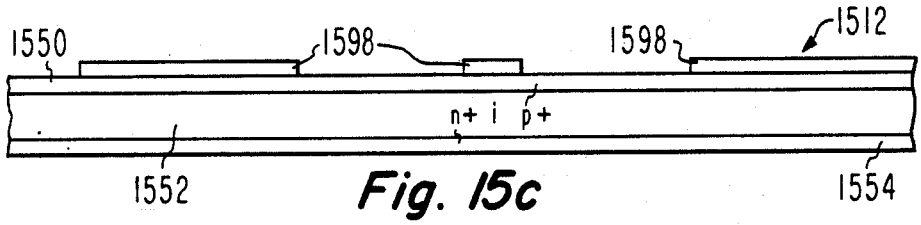
Figure 15D:
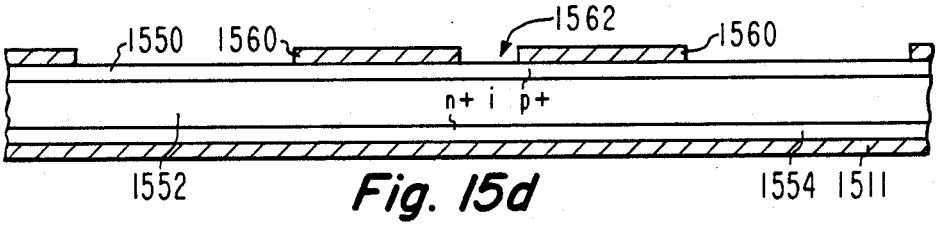
Figure 15E:
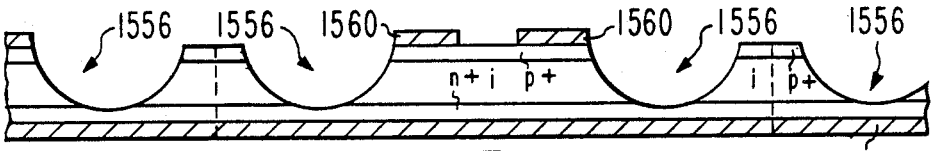
Figure 15F:
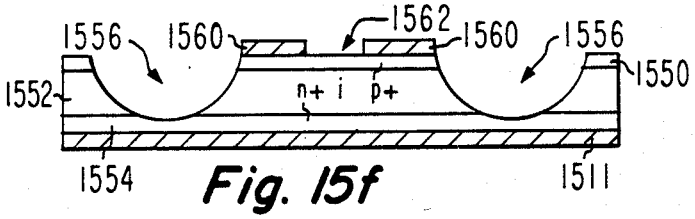
Figure 16:
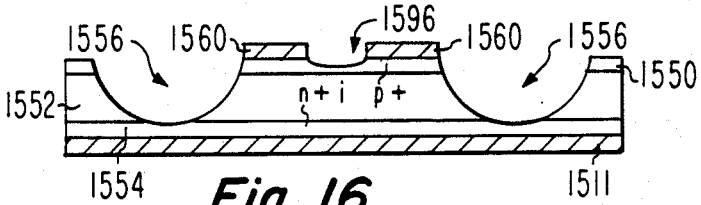
* and FIG. 16 illustrates a step in addition to those illustrated in FIGS. 15*a*–15*f* which may be used in the fabrication of the PIN diode of FIGS. 8*c* and 9*c*.

FIG. 15*a*–15*f* illustrate steps in the formation of a discrete diode such as diode 230 of FIG. 2*c*. FIG. 15*a* illustrates an intrinsic (i) semiconductor substrate 1512 which may be Si, GaAs, or other semiconductor material. FIG. 15*b* illustrates the result of heavily doping the upper side of substrate 12 with an acceptor impurity such as boron, for a Si substrate and beryllium for a GaAs substrate to form p+ region 1550, and heavily doping the lower side of substrate 1512 with a donor impurity (such as phosphorus for Si and silicon in the case of GaAs) to form n+ region 1554, leaving an intrinsic region 1552 therebetween. FIG. 15*c* illustrates the result of photolithographic application of a mask 1598 at selected locations on the upper surface of substrate 1512. Metal is applied to the unmasked portions of the upper and lower surfaces of substrate 1512, and the mask is removed, thereby leaving a structure such as that illustrated in FIG. 15*d*, with metallized regions of the upper surface designated 1560 which define a window 1562. The upper surface of the structure of FIG. 15*d* is then masked to leave exposed the regions in which moats are to be formed, and the unmasked regions are etched to form moats illustrated as 1556. Finally, the substrate is scribed and diced along the dotted lines in FIG. 15*e* to form the final structure illustrated in FIG. 15*f*.

FIG. 16 illustrates the result of dividing the above-described etching step into two parts. During the first part, the etching proceeds to a point at which moats 1556 (FIG. 15*e*) are partially formed. During the second step, a portion of the mask above window 1562 is removed, and the etching is again performed to complete the formation of moats 1556, and to create a shallow depression or trench 1596 below window 1562, thereby creating a location for receiving a fiber optic cable such as those illustrated in FIGS. 8*c* and 9*c*.

Other embodiments of the invention will be apparent to those skilled in the art. For example, the light source may be monochromatic or polychromatic, visible or invisible, coherent or incoherent, and may have its frequency selected for maximum absorption or effect in the photosensitive semiconductor. Reflectors or directors may be used to direct the light to the appropriate photosensitive elements. In addition to photosensitive diodes, photosensitive elements or material may be used, such as cadmium sulfide (CaS) elements. Doping may or may not be necessary, depending upon the material selected. In addition to aiding the light bias by the use of electrical bias, it is possible to aid the light bias by control of the temperature of the photosensitive element; in the case of a diode, the offset voltage is affected by temperature. Electrical bias may be controlled in response to diode temperature for stabilizing the response to light bias. The low pass filter which applies direct electrical bias to the antenna or its feed line may be a discrete or a distributed structure, as is known in the filter arts. The short-circuiting structure equivalent to solenoidal windings 225 and conductor 218 (FIGS. 2*a* and 2*b*) may be implemented as nonsolenoidal conductors in conjunction with quarter-wavelength lengths of transmission line.

What is claimed is:

1. An antenna, comprising a dielectric plate including first and second broad sides;

a first flat conductive region attached to said first broad side;

a second flat conductive region attached to said first broad side, said second flat conductive region being separated from said first flat conductive region by a nonconductive gap;

a further flat conductive surface attached to said second broad side to define a ground plane, said ground plane coacting with said first flat conductive region for, when electrically energized at a first frequency, producing electromagnetic radiation with particular characteristics;

photosensitive means including first and second electrodes, said first electrode being coupled to said first flat conductive region and said second electrode being coupled to said second flat conductive region for, when biased, coupling said first and second flat conductive regions together for producing electromagnetic radiation with particular characteristics when said coupled first and second flat conductive regions are energized at a frequency; and light control means coupled to said photosensitive means for controllably biasing said photosensitive means for controllably coupling said first and second flat conductive regions together, whereby said antenna is tuned differently than in the absence of bias.

2. An antenna according to claim 1 wherein said photosensitive means is a diode.

3. An antenna according to claim 2 wherein said diode is a PIN diode.

4. An antenna according to claim 3 wherein said PIN diode is a lateral diode.

5. An antenna according to claim 3 wherein said PIN diode is a vertical diode.

6. An antenna according to claim 1 wherein said light control means comprises:

light generating means; and light coupling means coupled to said light generating means and to said photosensitive means for coupling light therebetween.

7. An antenna according to claim 6, wherein said light generating means comprises a lamp.

8. An antenna according to claim 6 wherein said light generating means comprises a laser.

9. An antenna according to claim 6 wherein said light coupling means comprises a material having waveguide properties.

10. An antenna according to claim 9 wherein said light coupling means comprises a fiber optic cable.

11. An antenna according to claim 10 wherein said fiber optic cable terminates within said dielectric plate.

12. An antenna according to claim 11 wherein said fiber optic cable enters said dielectric plate from said second broad side.

13. An antenna according to claim 1 wherein said dielectric plate comprises a semiconductor material.

14. An antenna according to claim 13 wherein said photosensitive means is formed within said semiconductor material.

15. An antenna according to claim 13 wherein said photosensitive means is a monolithic diode formed within said semiconductor material.

16. An antenna according to claim 15 wherein said monolithic diode is a PIN diode.

17. An antenna according to claim 16 wherein said PIN diode is a lateral diode.

18. An antenna according to claim 17 wherein said lateral diode is annular.

19. An antenna according to claim 16 wherein said PIN diode is a vertical diode.

20. An antenna array, comprising:

a plurality of conductive electromagnetic radiating elements arranged in an array;

a plurality of photosensitive semiconductors, at least one of said plurality of photosensitive semiconductors being coupled with each of said conductive electromagnetic radiating elements for selecting the electrical characteristics of the associated radiating element in response to selection of the characteristics of said semiconductor;

electrical signal feed means adapted to be coupled to one of a signal source and signal utilization means and to said plurality of conductive electromagnetic radiating elements for coupling signal between said plurality of conductive electromagnetic radiating elements and said one of a signal source and signal utilization means; and light coupled control means coupled to each of said plurality of photosensitive semiconductors for selective illumination thereof with light for control of the electrical characteristics of said electromagnetic radiating elements.

21. An array according to claim 20 wherein each of said photosensitive semiconductors comprises a PIN diode.

22. An array according to claim 20 wherein said electrical signal feed means comprises a corporate feed.

23. An array according to claim 20 wherein said light coupled control means comprises:

a controllable source of light;

fiber optic cable means coupled to said controllable source of light and to at least one of said photosensitive semiconductors for coupling light from said controllable source of light to said at least one of said photosensitive photoconductors; and control means coupled to said controllable source of light for selectively energizing said controllable source of light for illuminating said at least one of said photosensitive semiconductors for selecting the characteristics thereof for selecting the characteristics of the associated electromagnetic radiating element or elements for control of the characteristics of the array.

24. An antenna, comprising:

a first conductor;

a second conductor;

a third conductor arranged in conjunction with said first conductor for electromagnetic radiation when energized at a feed point by an alternating current, thereby defining an antenna;

feed means coupled to said feed point of said first and third conductors and adapted to be coupled to one of a source of alternating current and a signal receiving means;

photosensitive means including first and second electrodes, said first electrode being coupled to said first conductor and said second electrode being coupled to said second conductor for controllably coupling said first and second conductors together for at least alternating current in response to bias, whereby at least a characteristic of said antenna is affected when said second conductor is coupled to said first conductor; and light control means coupled to said photosensitive means for controllably biasing said photosensitive means with light, whereby selective application of bias light to said photosensitive means affects said at least one characteristic of said antenna.

* * * * *